US007798391B2

(12) United States Patent
Tibbels et al.

(10) Patent No.: US 7,798,391 B2
(45) Date of Patent: Sep. 21, 2010

(54) DISPLAY READY CONTAINER

(75) Inventors: Brian Tibbels, Cochranville, PA (US); Carl Jeffrey Jolley, Plymouth Meeting, PA (US)

(73) Assignee: Innovative Packaging Designs L.P., Montgomeryville, PA (US)

( * ) Notice: Subject to any disclaimer, the term of this patent is extended or adjusted under 35 U.S.C. 154(b) by 615 days.

(21) Appl. No.: 11/277,583

(22) Filed: Mar. 27, 2006

(65) Prior Publication Data

US 2007/0221715 A1 Sep. 27, 2007

(51) Int. Cl.
*B65D 43/08* (2006.01)
*B65D 17/00* (2006.01)

(52) U.S. Cl. ..... 229/125.19; 229/125.29; 229/235; 229/225; 229/210; 229/211

(58) Field of Classification Search ..... 229/125.19, 229/125.29, 210, 211, 235, 125.16, 225, 229/102
See application file for complete search history.

(56) References Cited

U.S. PATENT DOCUMENTS 3,043,490 A * 7/1962 Burnett ..... 229/120.011
3,850,362 A * 11/1974 Stollberg et al. ..... 229/117.06
3,967,774 A * 7/1976 Querner ..... 229/125.19
5,105,950 A * 4/1992 Gottfreid et al. ..... 229/210
5,348,147 A * 9/1994 Gottfreid ..... 206/215
5,417,366 A * 5/1995 Hanko et al. ..... 229/227
5,505,368 A * 4/1996 Kanter et al. ..... 229/122.32
5,507,430 A * 4/1996 Imhoff ..... 229/125.19
6,685,084 B2 * 2/2004 Timbrook et al. ..... 229/101.1
6,874,679 B2 * 4/2005 Tibbles et al. ..... 229/122.33

* cited by examiner

*Primary Examiner*—Gary E Elkins
*Assistant Examiner*—Latrice Byrd
(74) *Attorney, Agent, or Firm*—Fox Rothschild, LLP

(57) ABSTRACT

A container assembly having an inner container and an outer cover that fits over the inner container. The inner container is positioned within the outer cover. The outer cover includes an overlay formed in the outer cover sidewalls by a tear line allowing the overlay to be detached from the outer cover. An adhesive secures the inner container and the outer cover together with the adhesive being provided between the inner container and the overlay so that the overlay can detach from the outer cover and remain attached to the inner container over the adhesive when the outer cover is removed from the inner container. A knockdown assembly that can be erected into a container assembly is also provided.

21 Claims, 9 Drawing Sheets

FIG.10
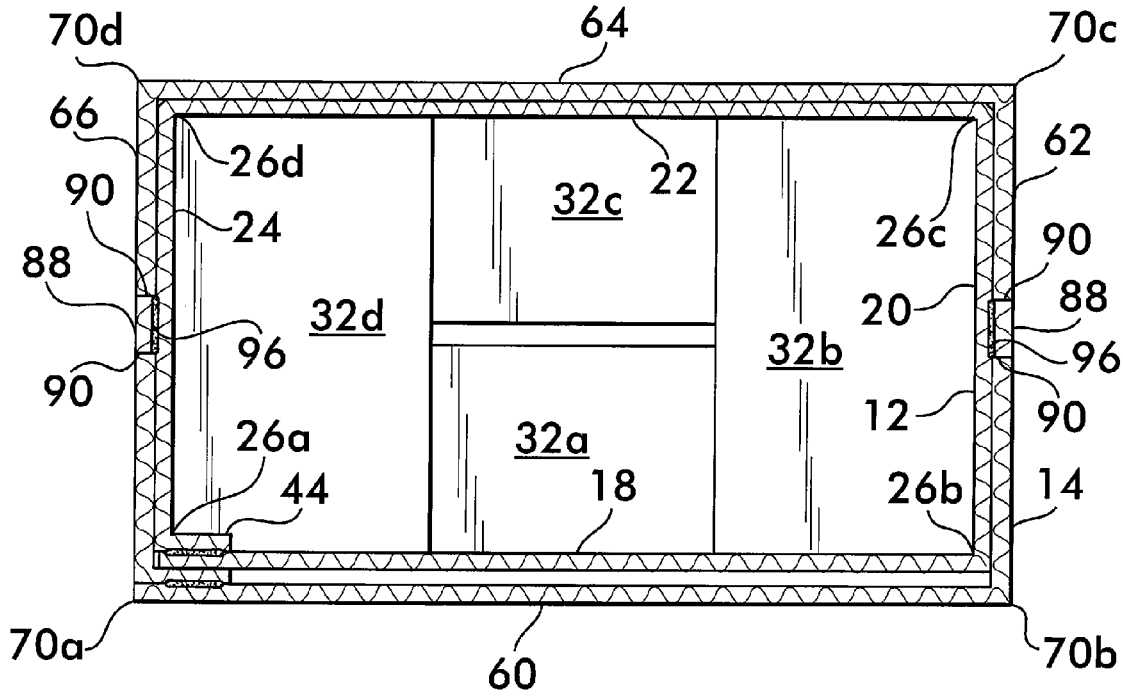
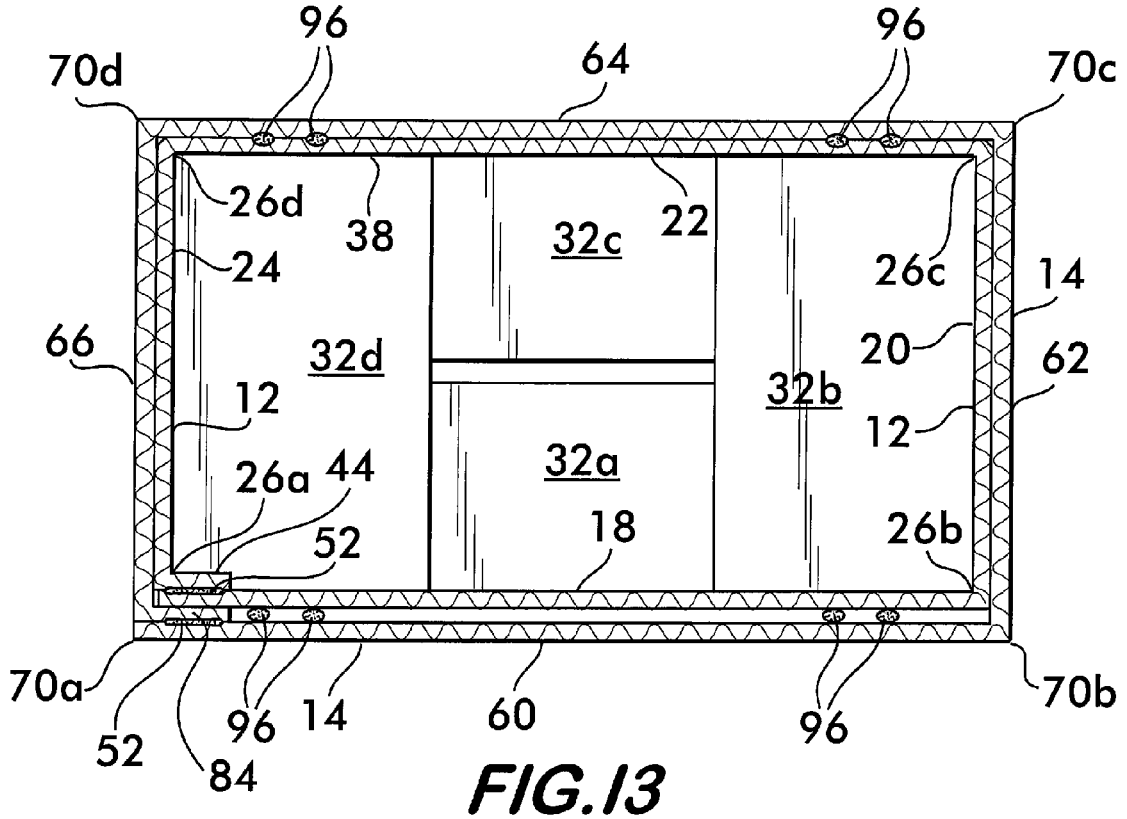
FIG.13

DISPLAY READY CONTAINER

BACKGROUND OF THE INVENTION

1. Field of the Invention

The present invention pertains to containers used for packaging, shipping, and displaying goods. More particularly, the invention relates to containers having a bottom or inner container section for holding goods therein, and an upper or outer cover section for covering the bottom section.

2. Description of the Related Art

Display ready containers have become very popular, particularly in retail stores where goods for sale are displayed in the container. A typical display ready container has separate top and bottom sections formed from separate corrugated blanks. The bottom section, also referred to as an inner container, has side walls and flaps for forming the container bottom. The upper section, also referred to as the outer cover section, has side walls and flaps for forming the container top. The upper section fits over the side walls of the bottom section to enclose the interior of the container and protect the goods inside. The upper and bottom sections can then be secured together for shipping. Once the container is at the retailer, the upper section can be removed to display the goods within the container.

Display ready containers are particularly useful as shipping-display containers. Used to package and ship goods for retail, the outside face of the bottom section can be printed and/or designed with promotional information suitable for display on the retail floor. The retailer removes the upper section of the container and places the bottom container section containing the goods on the retail floor.

A previous disadvantage of such two piece containers is the number of steps necessary to assemble the container. This disadvantage was overcome with the development of display ready containers that allow for the automation of the set up, packaging and sealing of such containers. One such display ready container is disclosed in U.S. Pat. No. 5,505,368 which is hereby incorporated herein by reference. This patent provides a container assembly having an unopened outer sleeve (that forms the outer cover section when erected), and an unopened inner sleeve (that forms the inner container section when erected) positioned inside the outer sleeve. The inner and outer sleeves, in a flat unopened form also known as a knockdown, are adhered together relative to one another in the positional relationship of the final erected container assembly which allows the top forming flaps of the container assembly to be closed. This allows the container to be filled with goods with the outer cover section (upper section) already secured to the bottom container section. Once the container is filled with the goods, the top forming flaps attached to the outer cover section are folded over and sealed shut to enclose the container for shipment, thereby eliminating the step of placing the outer cover section over the bottom section, and thereby improving the automation of the packaging process. The retailer then separates the two container sections by breaking the adhesive joints between the two container sections, discarding the upper cover section, and using the bottom container section to hold and display goods on the retail floor.

One problem with such improved display ready containers is that when breaking the adhesive joints between the two container sections, the outer surface of the inner container can tear, marring the printed image visible to the customer. Accordingly, one object of the present invention is to provide an improved display ready container that avoids this problem. Other advantages will be obvious or may be learned by practice of the invention.

SUMMARY OF THE INVENTION

In one form the present invention provides a container assembly having an inner container and an outer cover that fits over the inner container. The inner container has multiple wall panels that form inner container sidewalls for holding the goods within the container assembly. The inner container also has a top edge and bottom forming flaps that extend from a bottom end of the side walls to form the container bottom. The outer cover has multiple wall panels that form outer cover sidewalls for fitting over the sidewalls of said inner container, and also has a bottom edge and top forming flaps extending from a top end of the outer cover side walls to form the container top. The inner container is positioned within the outer cover. The outer cover further includes an overlay formed in the outer cover sidewalls by a tear line allowing the overlay to be detached from the outer cover along the tear line. An adhesive secures the inner container and the outer cover together with the adhesive disposed between the inner container side walls and the overlay of the outer cover so that the overlay can remain attached to the inner container over the adhesive when the outer cover is removed from the inner container. Thus, when the outer cover is removed from the inner container, the adhesive joint between the inner container and outer cover is not broken. Instead, the outer cover is detached from the overlay which remains attached to and over the adhesive, thereby avoiding the tearing or marring of the surface of the inner container which might otherwise happen should the adhesive joint be broken.

The present invention also provides a container knockdown assembly capable of being erected into a container assembly that has an inner container for holding goods within it and an outer cover enclosing the inner container. The knockdown assembly includes an inner sleeve capable of forming the inner container when the knockdown assembly is erected, and an outer sleeve capable of forming the outer cover when the container assembly is erected. The inner sleeve has first and second inner sleeve walls which include the container sidewalls, a top edge, and a bottom forming flap opposite the top edge which can form the container assembly bottom. The outer sleeve has first and second outer sleeve walls which include the outer cover sidewalls, a bottom edge, and a top forming flap opposite the bottom edge which can form the container assembly top. The inner sleeve is positioned within and relative to the outer sleeve in a positional relationship of the erected container assembly. The outer sleeve further includes an overlay formed in the outer cover sidewalls by a tear line allowing the overlay to be detachable from the outer sleeve along the tear line. Adhesive secures the inner and outer sleeves together in the aligned positional relationship of the erected container assembly, the adhesive being provided between the side walls of the inner sleeve (inner container) and the adhesive overlay of the outer sleeve (outer cover) so that the overlay can remain attached to the inner container over the adhesive if the outer cover is removed from the inner container. The knockdown is ideal for automated packaging equipment.

BRIEF DESCRIPTION OF THE DRAWINGS

The foregoing summary, as well as the following detailed description, will be better understood when read in conjunction with the accompanying drawings. For the purpose of illustrating the invention, there are shown in the drawings preferred embodiments. It is understood, however, that this invention is not limited to these embodiments and are to be limited only by the appended claims.

FIG. 6 is an exploded view of the container of FIG. 1 showing the two container sections being separated from one another;

FIG. 13 is a cross-sectional view of the container assembly of FIG. 11 taken along lines 13-13.

DETAILED DESCRIPTION

Figure 1:
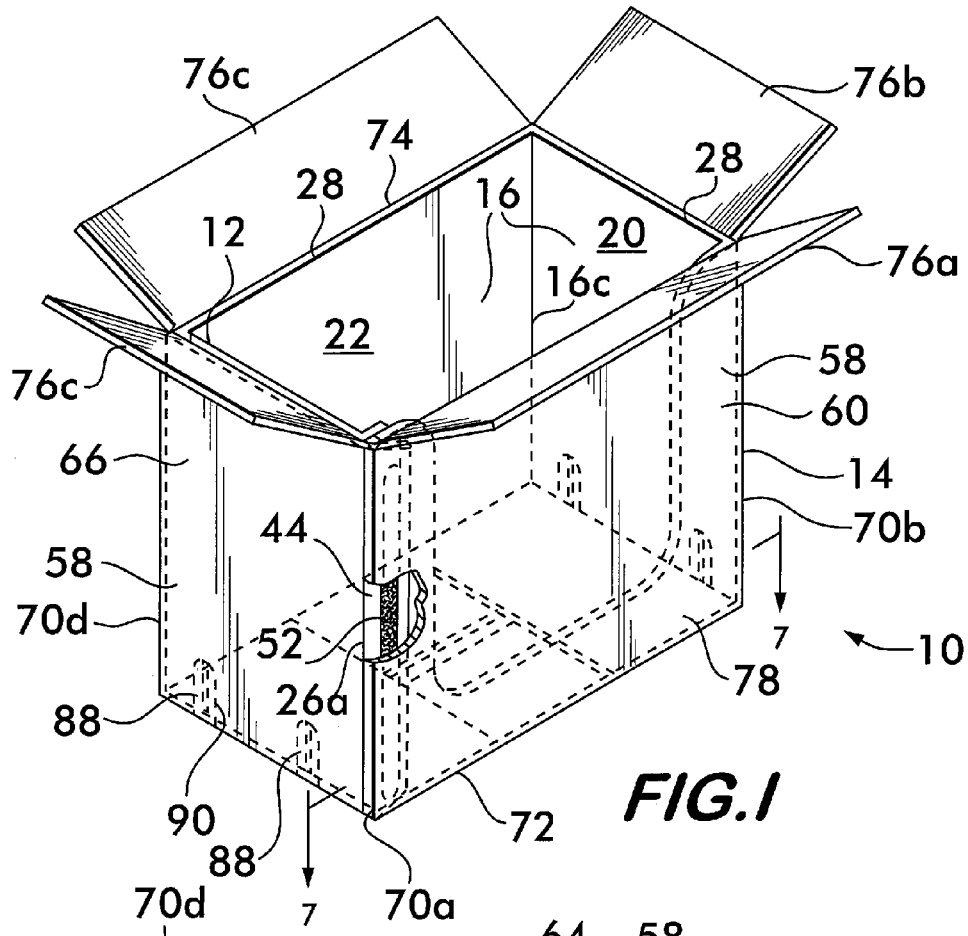
FIG. 1 is a perspective view of a container assembly made in accordance with the present invention showing the inner container within the outer cover, and the top flaps folded outwardly.

The invention disclosed herein provides a novel container assembly and a container knockdown assembly. Described below are several illustrative embodiments of the invention suited for containers used for shipping and displaying goods for retail. It is understood, however, that the present invention is not so limited and can be adapted to other containers.

Reference now will be made in detail to the embodiment shown in FIGS. 1 through 7. With initial reference to FIG. 1, display ready container assembly 10 has an inner container 12, shown partially in dotted line where hidden, which is adapted to fit within an outer container cover 14. These two container sections 12 and 14, with the inner container 12 fixedly secured within the outer cover 14, form the display ready container assembly 10. The inner container 12 holds the goods to be contained within, and the outer cover 14 will ultimately enclose the inner container 12. The individual display ready container sections 12 and 14 are now described separately in more detail.

Figure 6:
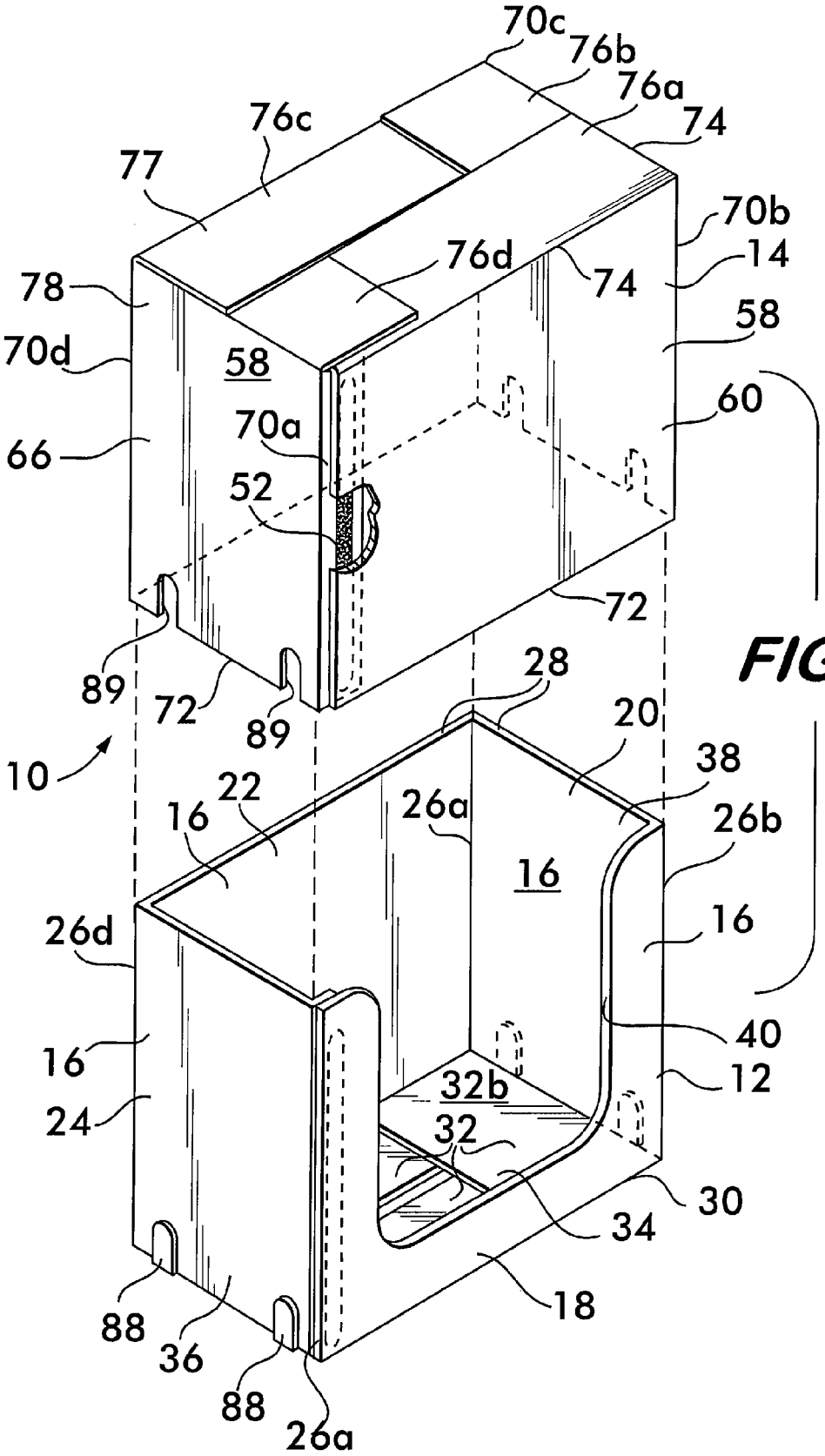
FIG. 6 is an exploded view of the container of FIG. 1 showing the two container sections separated from one another.

With further reference to FIG. 6, showing the inner container 12 being removed from the outer cover 14, the inner container 12 includes inner container sidewalls 16 which form the front wall 18, side wall 20, rear wall 22 and second side wall 24, and which are attached to one another at corners 26*a*, 26*b*, 26*c*, and 26*d*. The container sidewalls 16 have a top edge 28 and a lower end 30. Bottom forming flaps 32, which include flaps 32*a*, 32*b*, 32*c*, and 32*d*, attached to and extending from the lower end 30 of the sidewalls 16, are foldable to form the bottom 34 of the inner container 12. The sidewalls 16 have an outer surface 36 and an inner surface 38. A display opening 40 is formed in the front wall 18 as shown.

Figures 2, 3:
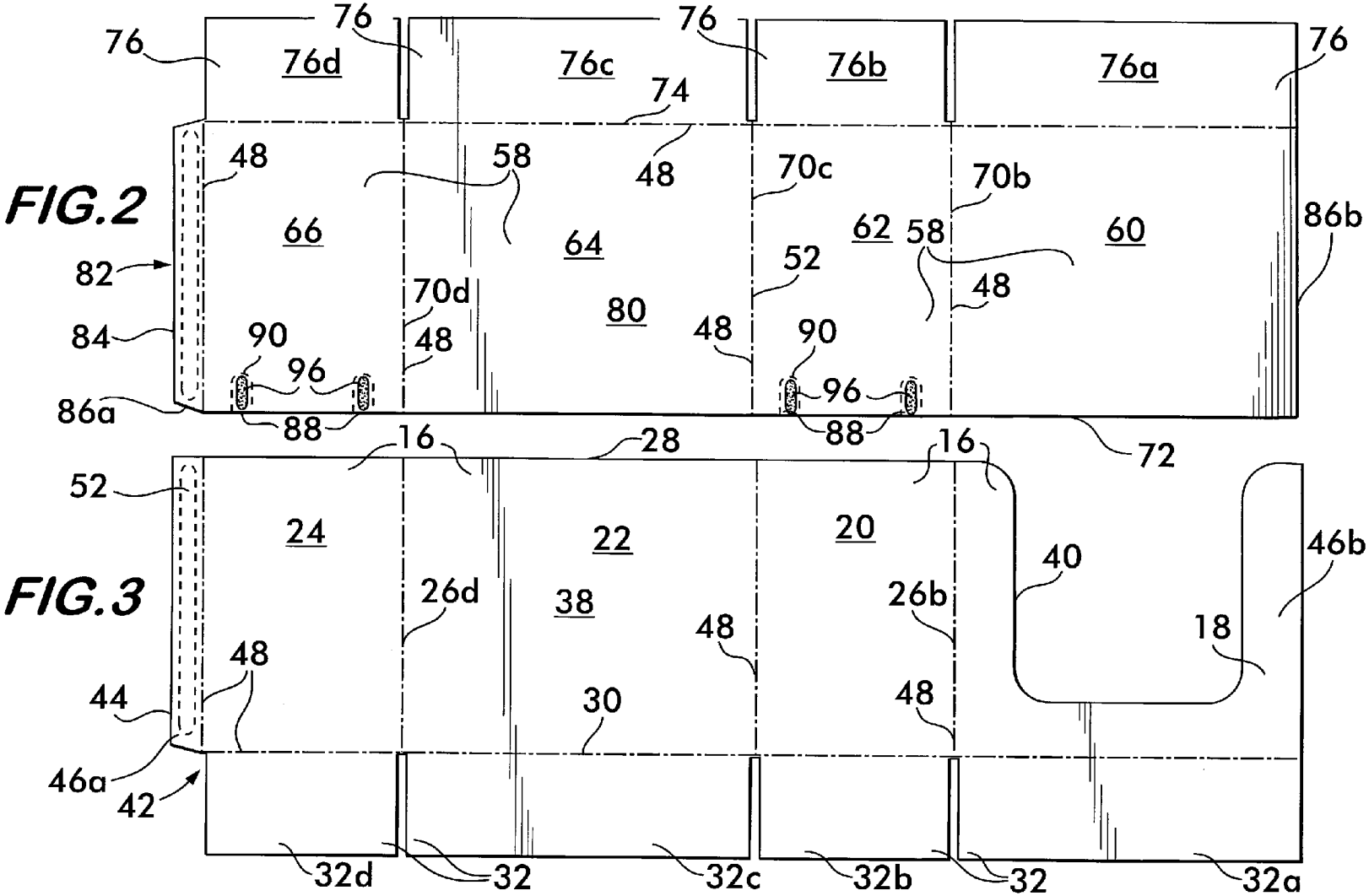
FIG. 2 is a plan view of a blank section for forming the outer container section of the container assembly in FIG. 1.
FIG. 3 is a plan view of a blank section for forming the inner section of the container assembly in FIG. 1.

The inner container 12 is preferably formed or cut from a unitary blank 42, preferably of corrugated paper board as shown in FIG. 3 which shows the inner surface 38. A glue tab 44 attached to the end of the side wall 24 is provided to connect one end 46*a* of the blank 42 to the other end 46*b* to form the inner container 12. Lines of weakness 48, such as scores or creases formed in corrugated paperboard, define the various sidewalls 16 and bottom forming flaps 32 and predispose the various sidewalls and flaps of the inner container 12 to fold easily along such lines. Any such line of weakness as known as the art may be used.

Figure 4:
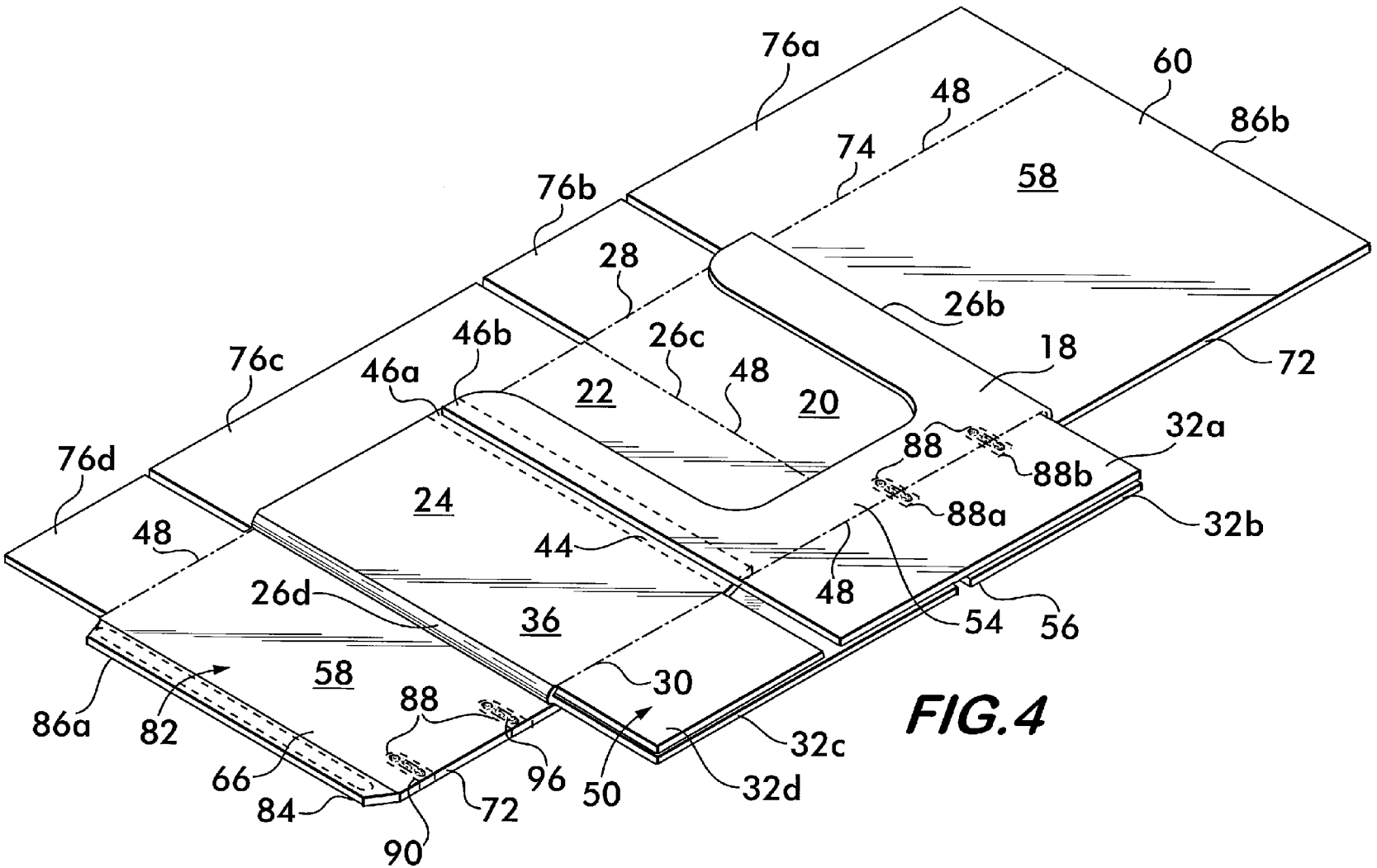
FIG. 4 is a perspective view showing a step of making the container assembly of FIG. 1, where the inner sleeve is positioned on the inner face of the blank that will form the outer sleeve.

The blank 42 for the inner container 12 is formed preferably into a two sided inner sleeve 50 as shown in FIG. 4, also referred to as a knockdown form or state, which can be erected into the inner container 12 as shown in FIG. 1. With reference to FIGS. 3 and 4, the inner sleeve 50 is formed by folding the side wall 24 and bottom flap 32*d* together as a unit, along the line of weakness 48 that will form the container corner 26*d*, onto the inner face 38 of adjacent side wall panel 22. Next, adhesive 52, such as a hot melt glue as known in the industry, is applied to the outside face 36 of the glue tab 44. Then the front side wall 18 and bottom flap 32*a* are folded as a unit, along the line of weakness 48 that will form the container corner 26*b*, onto the inner face 38 of adjacent side panel 20 and a portion of rear wall 22 such that the blank end 46*b* contacts the glue tab 44 to adhesively secure the two walls 18, 24 together, and thereby form the two sided inner sleeve 50 as shown in FIG. 4. It is seen, with reference to FIG. 4, that the sleeve 50 has two sleeve walls 54 and 56 attached to one another at the corners 26*b* and 26*d*. The first sleeve wall 54 (the upper wall) includes the inner container walls 18 and 24 and bottom flaps 32*a* and 32*d* in a substantially same plane, and the second sleeve wall 56 (the lower wall) includes the walls 20 and 22 and bottom flaps 32*b* and 32*c* in a substantially same plane parallel to the first sleeve wall 54. The corners 26*a* and 26*c* of the inner container 12 are not yet folded or formed. The inner sleeve 50 is erected into the inner container 12 in a manner further described below.

The outer cover 14 is now described with reference to FIGS. 1, 2, 4, 6 and 7. With initial reference to FIGS. 6 and 7, the outer cover 14 includes outer cover sidewalls 58 which form the cover front wall 60, side wall 62, rear wall 64 and second side wall 66, and which are attached to one another at corners 70*a*, 70*b*, 70*c*, and 70*d*. The sidewalls 58 have a bottom edge 72 and an upper end 74. Top forming flaps 76, which include flaps 76*a*, 76*b*, 76*c*, and 76*d* attached to and extending from the upper end 74, can be folded to form the top 77 of the outer cover 14 as shown in FIG. 6. The sidewalls 66 have an outer surface 78 and an inner surface 80.

The outer cover 14 is preferably formed or cut from a unitary blank 82 preferably of corrugated paper board as shown in FIG. 2 which shows the inner surface 80. A glue tab 84 attached to the end of side wall 66 connects one end 86*a* of the blank 82 to the other end 86*b* to form the outer cover 14. Lines of weakness 48 define the various sidewalls 58, top forming flaps 76 and glue tap 84, and predispose the various wall and flap panels of the outer cover 14 to fold easily along such lines.

The outer cover 14 includes an adhesive overlay 88 formed in the sidewalls 58 of the outer cover 14 by a tear line 90 which allows the overlay 88 to be detached from the outer cover 14 along this tear line. The tear line 90 can be formed in any suitable manner which allows separation of the overlay from the outer cover, such as perforations or cuts in corrugated paperboard. The overlay 88 is used to cover adhesive 96 securing the inner container 12 and outer cover 14 to one another and prevent tearing of the container assembly when the two container assembly sections 12 and 14 are separated from one another.

Figure 7:
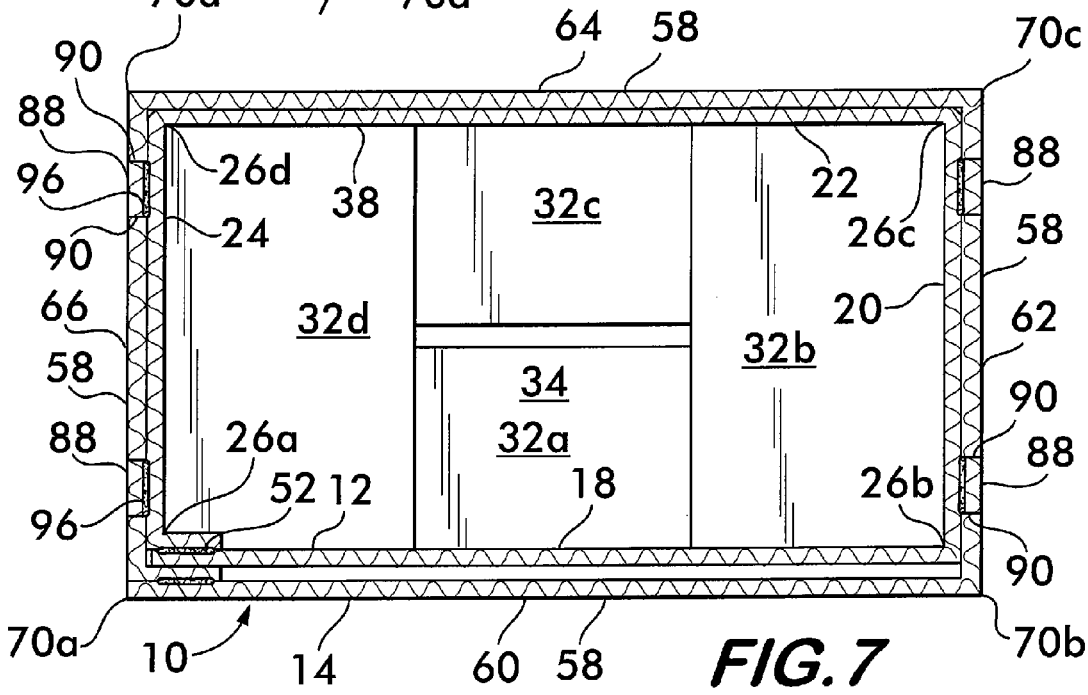
FIG. 7 is a cross-sectional view of the container assembly of FIG. 1 taken along lines 7-7.

In the presently illustrated embodiment, four overlays 88 are provided. With reference to FIGS. 1, 2, and 7, it is seen that the overlays 88 are formed along a section of the bottom edge 72 of the two side walls 62 and 66 of the outer cover 14 and extends vertically there from. The tear line 90, in conjunction with the bottom edge 72, defines the overlays 88 and allows the overlays to be separated from the outer cover 14 as illustrated in FIG. 6, which shows the overlay 88 detached from the outer cover 14 and attached to the inner container 12 for reasons further discussed below. For the present, it is sufficient to understand that inner container 12 and outer cover 14 are attached or fixed to one another with adhesive at the overlays 88.

Figure 5:
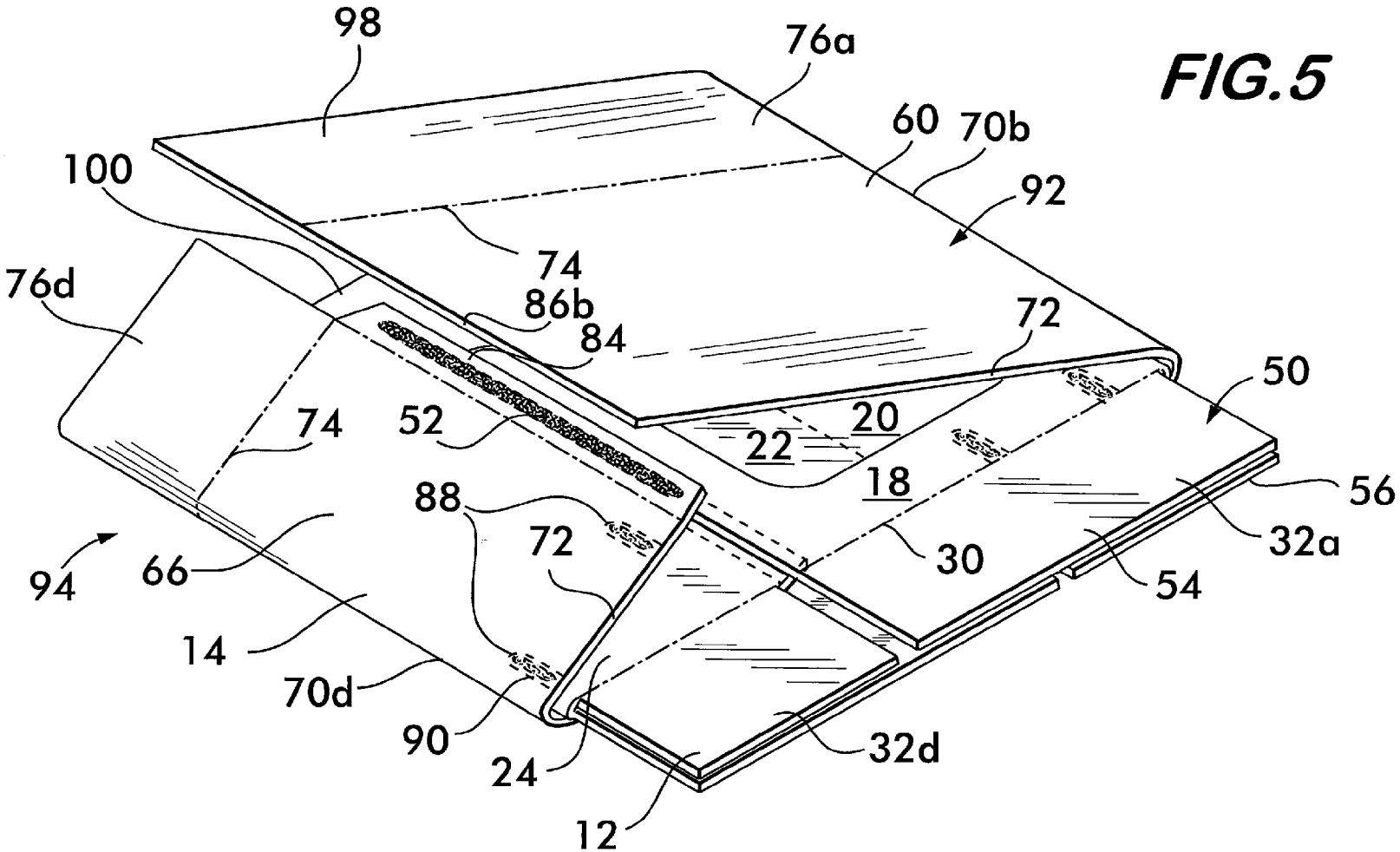
FIG. 5 is a perspective view showing a step of making the container assembly of FIG. 1 that comes after the step shown in FIG. 4.

Description of the formation of the outer cover 14 from the blank 82 as shown in FIG. 2 is continued with reference to FIGS. 2, 4 and 5. The blank 82 for the outer cover 14 is preferably formed into an outer sleeve 92 around the inner sleeve 50 (which forms the inner container 12), to form a container knockdown assembly 94 as illustrated in FIG. 5 (although the final knockdown 94 would be substantially flat after the two sidewalls 60 and 66 are adhered together as further described below). With initial reference to FIG. 2, an adhesive 96 is applied to the inner face 80 of the blank 82 within the area defined by the overlays 88. Any suitable adhesive of sufficient strength and amount can be used, such as hot melt glue. The adhesive should preferably hold the overlays in place and break the tear line 90 when the inner container 14 is removed. Next, as illustrated in FIG. 4, the inner sleeve 50 is laid onto the inner face 80 of the blank 82 and positioned relative to the blank 82 in a positional relationship of the inner container 12 and outer cover 14 when the container assembly 10 is erected as shown in FIG. 1. Accordingly, in the illustrated embodiment shown in FIG. 4, the inner container walls 20 and 22 of the inner sleeve 50 (inner container 12) are positioned on and aligned with the outer cover side walls 62 and 64 respectively of the blank 82 (outer cover 14); the fold line 48 of the inner sleeve 50 that will form the inner container corner 26*c* is aligned with the fold line 48 that will form the outer cover corner 70*c*; the top edge 28 of the inner container sleeve 12 is aligned with or below the top end 74 of the outer cover side walls 58 so as not to prevent the top forming flaps 76*a*, 76*b*, 76*c*, and 76*d* from folding to form the top 77 enclosing the erected container 10 as shown in FIG. 6. Preferably, as illustrated, the top edge 28 of the inner container sleeve 12 aligns with the top end 74 of the outer cover 14 so that the top edge 28 of the inner container can provide additional support for the top flaps 76 when they are folded. Moreover, it is seen that the overlays 88*a* and 88*b*, with adhesive on the inside face of the overlays, are adhered at this time to the outer face of the sidewall 20 of the inner container sleeve 50.

Next, with further reference to FIG. 5, the side wall 66 and top flap 76*d* are folded as a unit along the line of weakness 48 that will form the outer cover corner 70*d*, onto the outside face 36 of side wall 24 of the inner container sleeve 50 (upper container 12). The overlays 88*c* and 88*d*, with adhesive 96, contact and adhere to the outer face of the sidewall 24 of the inner container sleeve 50.

Adhesive 52, such as a hot melt glue, is then applied to the outside face 78 of the glue tab 84, and then the front wall 60 and top flap 76*a* of the blank 82 are folded as an integral unit along the line of weakness 48 that will form the container corner 70*b*, onto the outer face 36 of side wall 18 of the inner container sleeve 50 such that the end 86*b* of the blank 82 contacts the adhesive 52 of the glue tab 84, thereby forming the two sided outer sleeve 92 (outer cover 14) which, in combination with the inner sleeve 50 (inner container 12), forms the display ready knockdown assembly 94. It is seen, with reference to FIG. 5, that the outer sleeve 92 has two sleeve walls 98 and 100 attached at the corners 70*b* and 70*d*. The first sleeve wall 98, the upper wall, includes the outer cover walls 60 and 66 and top flaps 76*a* and 76*d* in a substantially same plane as seen in FIG. 5. The second sleeve wall 100, the lower wall, includes the outer cover walls 62 and 64 and top flaps 76*b* and 76*c* in a substantially same plane parallel to the first sleeve wall 98. The corners 70*a* and 70*c* of the outer cover 14 are not yet folded or formed. The outer sleeve 92 is erected into the outer cover 14 as further described below.

Once the outer sleeve 92 is formed with the inner sleeve 50 secured within it, it is seen that a flat container knockdown assembly 94 is formed. Such flat assemblies are efficiently stacked for storage and shipment.

The "positional relationship" of the inner container 12 and outer cover 14 of the erected container assembly 10 as discussed above is the relative position of the inner container 12 and outer cover 14 relative to one another in the erected container assembly 12 as seen in FIG. 1 and as closed as shown in FIG. 6. By securing the two sections 12 and 14 at this relative position to one another during the manufacture of the knockdown assembly 94, it is appreciated that no further handling of the cover 14 relative to the inner container is to be made. For example, with reference to FIGS. 5 and 1, the knockdown assembly 94 is opened into the erected configuration of FIG. 1 and the bottom flaps 32 folded to form the bottom 34. With the top flaps 76 open, goods can be loaded into the container 12. Once loaded, the container assembly 10 is closed simply by folding the top flaps 76 of the outer cover 14. Since the outer cover 14 was previously attached to the inner container 12 at the positional relationship of the erected and closed container assembly 10, the enclosure process is complete and the container 10 is ready for stacking with other containers and shipping. This eliminates the step of placing a separate outer cover section over an inner container after the loading of the goods.

Referring to FIG. 1, container knockdown assembly 94 is erected by pushing the corners 70*b* and 70*d* toward each other, folding and forming the corners 70*a* and 70*c* of the outer cover 14 and corners 26*a* and 26*c* of the container 12 until an erected container assembly 10 is formed as shown in FIG. 1. It is seen that this opens both of the inner and outer sleeves 50, 92 as a single unit. The bottom forming flaps 32 of the inner container 12 are then folded and secured to form the container bottom 34, allowing the container assembly 10 to be loaded with goods. Once the goods are loaded, the top forming flaps 76 of the outer cover 14 are folded and secured to form the top 77 to enclose the goods within the container 10 for shipment. It is seen that in this preferred embodiment, the height of the sidewalls 16 and 54 of respective inner container 12 and outer cover 14 are substantially the same so that the outer cover 14 fully covers the inner container 12 and positions the overlays 88 along the bottom of the inner container 12. Moreover, this configuration provides two layers of support on each side of the container assembly 10 which increases the strength of the assembly 10.

As illustrated in FIG. 6, the outer cover 14 is being removed from the inner container 12 to display the goods held within the inner container 12. This is accomplished by detaching the overlays 88 from the outer cover 14 and lifting the outer cover 14 from the inner container 12 as shown. Openings 89 are seen in the outer cover 14 from where the overlays 88 were detailed. In one preferred embodiment, using a sufficiently strong adhesive 96 between the overlays 88 and the inner container 14, each of the lower ends of the outer cover sidewalls 62 and 64 are gripped with a person's hands between the two overlays 88 and pulled away from the inner container 12 so as to break the overlays 88 from the outer cover 14 along the tear line 90.

Since the inner container 12 may be used to display the goods on the retail floor, the outer face 36 of the side walls 16 may be printed with an esthetic design or some suitable promotional information. The overlays 88, through which the inner container 12 is adhesively fixed to the outer cover 14, remains with and adhered to the inner container 12 when the outer cover 14 is removed, thereby avoiding the need to break the adhesive joints between the overlays 88 and the inner container 12, and thereby prevent the tearing and marring of the outer face 36. The outer face 78 of the overlays 88 can be printed to match the design on the inner container 12.

The present invention thereby provides a container knockdown assembly 94, which is simple and efficient to make, and a container assembly 10 which in a preferred form, is easily erected from a knockdown assembly 94, both of which are improved over previously known display ready containers.

Figure 8:
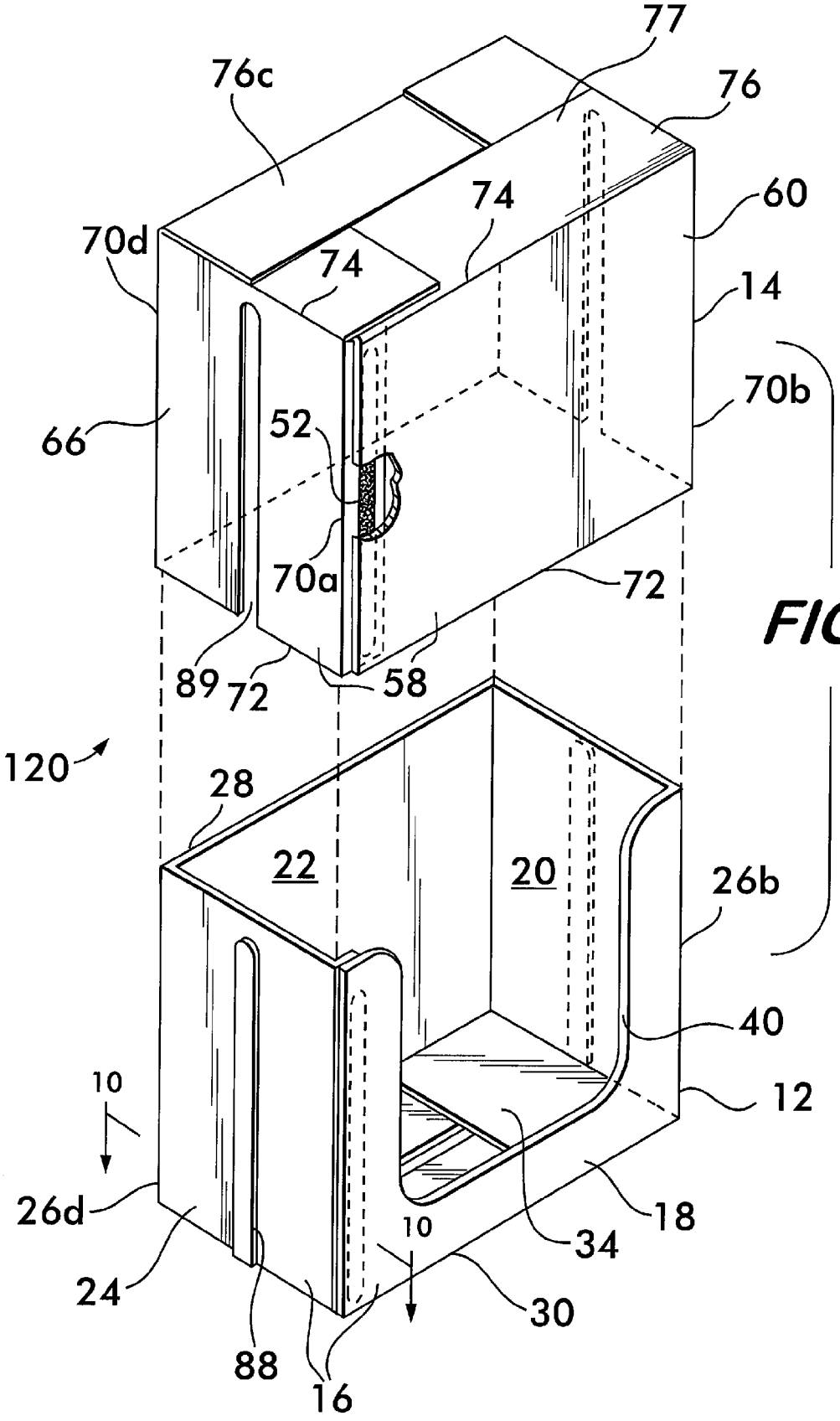
FIG. 8 is an exploded view of another embodiment of the present invention showing two container assembly sections being separated from one another and the top flaps folded inward to enclose the container.

A container assembly 120 of a second embodiment of the present invention is now described with reference to FIGS. 8 to 10. The container assembly 120 is similar in construction to the container assembly 10 of FIG. 1 and can be erected from a container knockdown in a similar manner. Accordingly, like elements in the drawings will be referenced with the same reference numbers as those used for the container assembly 10 describe previously. The inner container 12 is identical to that in FIG. 1, and overlay 88 is formed as a vertical strip extending vertically from the bottom 72 of the outer cover 14 similar to the overlay 88 of the container assembly 10. Here, however, there is only one overlay 88 formed in each of the two outer cover sidewalls 62 and 64, in these overlays 88 extend vertically to near the top end 74 of the side walls 62 to 64.

Figure 9:
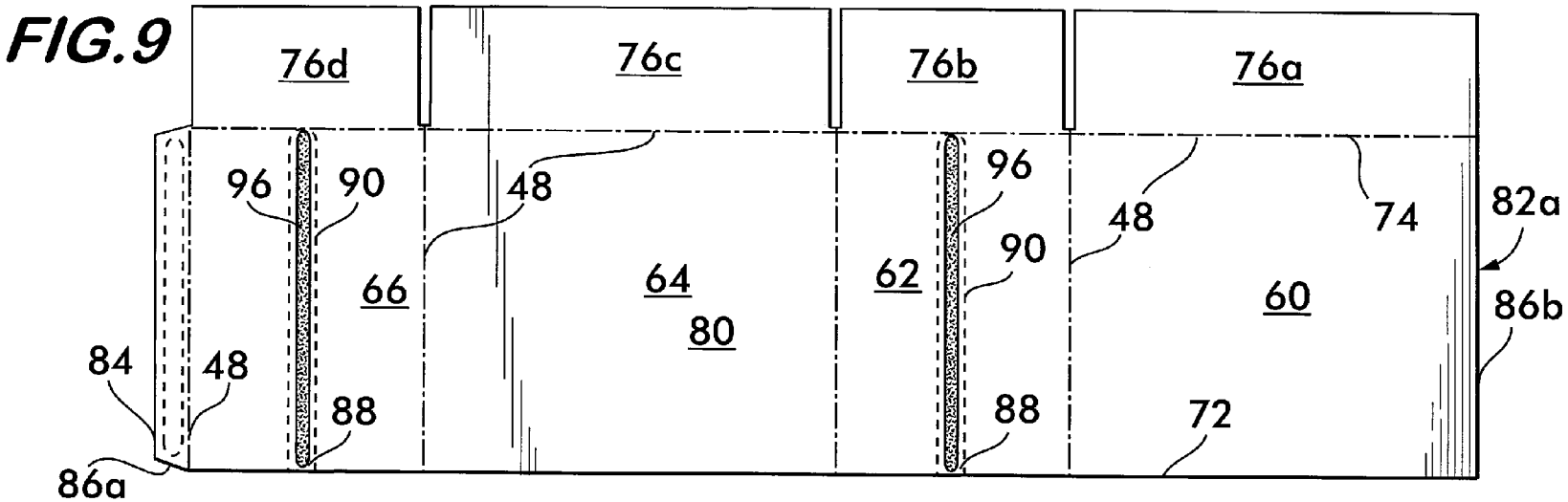
FIG. 9 is a plan view of a blank section for forming the outer container section of the container assembly in FIG. 8.

FIG. 9 shows the inside face 80 of a preferred blank 82*a* for forming the outer cover 14 for the container assembly 120. It is identical to the blank 82 of the container assembly 10 shown in FIG. 2 with the exception that the overlays 88 extend vertically from the bottom edge 72 to the top end 74 of the side walls 62 and 66. A tear line 90 forms the overlays 88. An adhesive 96 for adhering the outer cover 14 to the inner container 12 is provided.

The container assembly 120 can be erected from a knockdown constructed similarly to that described previously with reference to FIG. 5. Likewise, the container assembly 120 can be erected from a knockdown assembly in a similar manner as the container assembly 10. Moreover, the container assembly 120 is erected, filled with goods, and enclosed in a similar manner as container assembly 10, the main difference being the number and vertical length of the overlays 88, highlighted in FIG. 8, which shows the overlays 88 detached from the outer cover 14 after the outer cover 14 has been removed.

Figure 12:
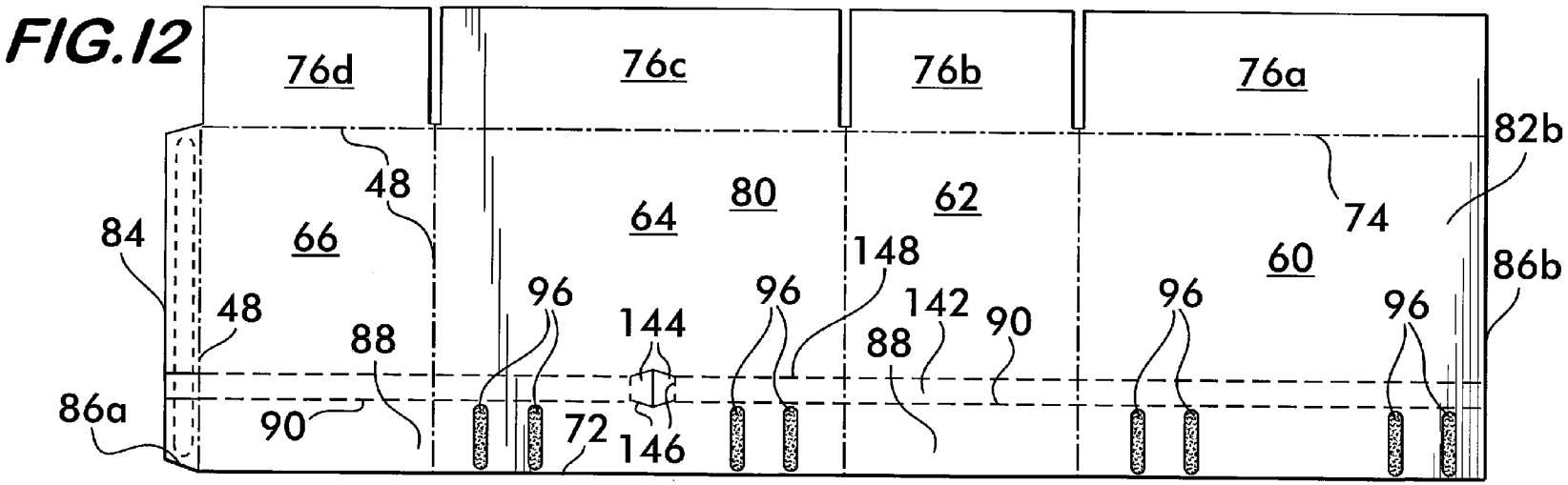
FIG. 12 is a plan view of a blank section for forming the outer container section of the container assembly in FIG. 11.
Figure 11:
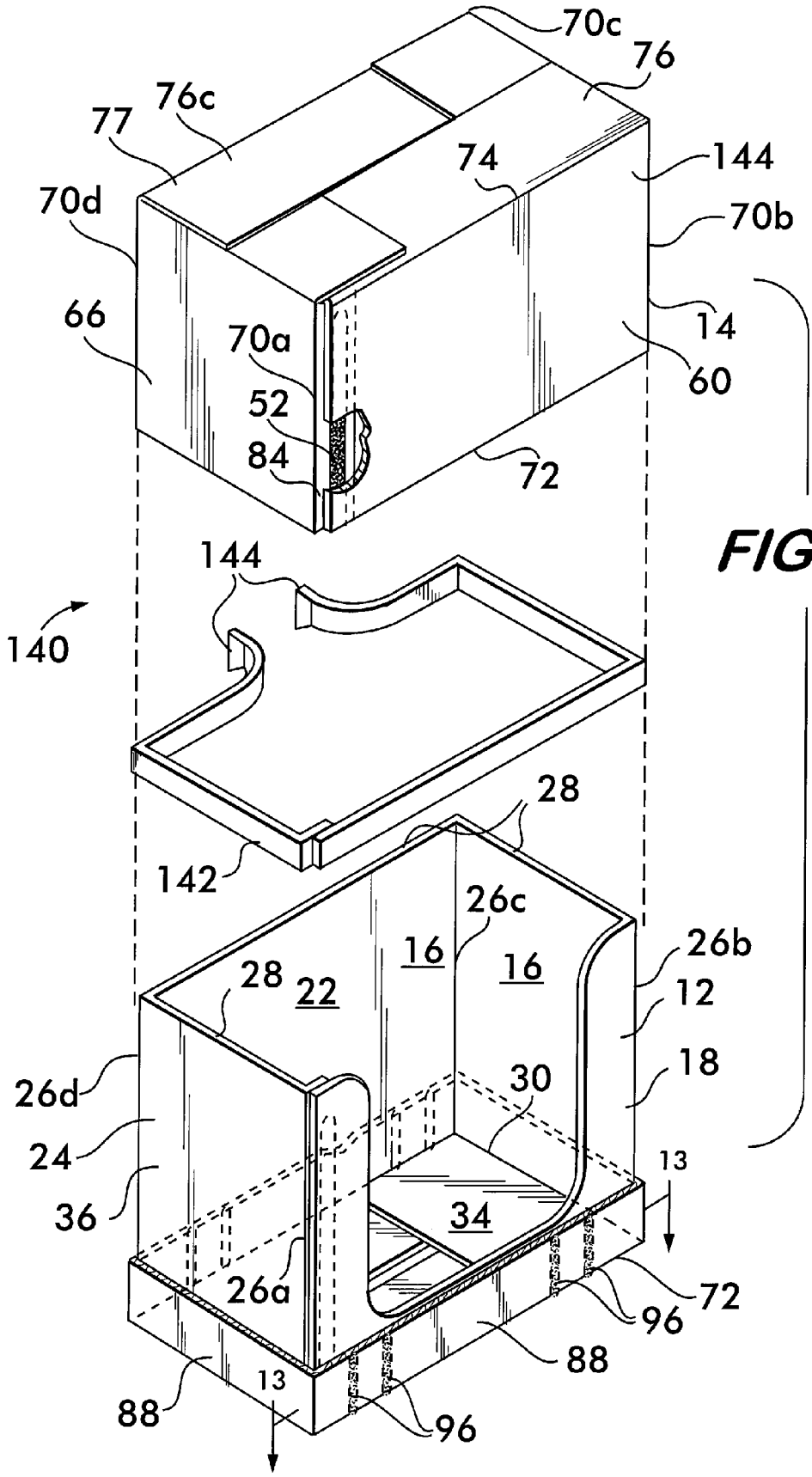
FIG. 11 is an exploded view of a third embodiment of the present invention showing two container sections separated from one another and the top flaps folded inward to enclose the container.

A container assembly 140 of a third embodiment is now described with a reference to FIGS. 11, 12 and 13. The container assembly 140 is similar to the container assemblies 10 and 120 described above with like elements referenced with the same reference numbers. The inner container 12 is identical to those of the two embodiments described previously.

Here, the overlay 88 differs from the overlays of the previous two embodiments and is now described in further detail. The overlay 88 includes all of the bottom edge 72 of the outer cover 14 and has a tear line 90 extending horizontally around the perimeter of the outer cover 14 spaced from the lower edge 72. A tear section 142, formed as a horizontal tear strip, is likewise formed in the outer cover 14 between the overlay 88 and the remainder 146 of the outer cover 14. The tear strip 142 can include two tabs 144 separated by cuts 146 which can be gripped and pulled to remove the tear strip 142. The tear strip has two separation sides, one side (the lower side) formed by the tear line 90 of the overlay 88, and the other separation side (the upper side) formed by a second tear line 148 between the tear strip 142 and the remainder of the outer cover 14.

FIG. 12 illustrates a preferred blank 82*b* for forming the outer cover 14, the inner face 80 of the blank being shown. Suitable amounts of adhesive 96 are provided between the overlay 88 of the outer cover 14 and the inner container 12. A knockdown assembly can be formed with the blank 82*b* for the outer cover 14 and the blank 42 of FIG. 3 for the inner container 14 in a similar manner as described above with reference to the container assembly 10 of FIG. 1. Likewise, the container assembly 140 can be erected from a knockdown assembly in a similar manner as the container assembly 10. To separate the container sections 12, 14, with specific reference to FIG. 11, tab 144 is pulled to remove the tear strip 142 and thereby separate the outer cover 14, i.e., the remainder 144, from the inner container 12. As with the previous embodiments, the overlay 88 remains adhered to the inner container 12 so that the adhesive 96 does not have to be broken, thereby avoiding any marring of the outer surface 36 of the inner container 12.

While particular embodiments of the invention are described herein, it is not intended to limit the invention to such disclosure. Changes and modifications may be incorporated and embodied within the scope of the appended claims. For example, those skilled in the art will also recognize that the present invention is not limited to the blanks illustrated. Other types of blanks may include self locking flaps for forming both top and bottom, and may include fold line means between the panels other than scored lines. Additionally, the overlay 88 can take on any suitable shape or configuration, including different widths, heights, and shapes from those illustrated above, as well as different numbers of overlays and alternative placements of the overlays from those illustrated above.

What is claimed is:

1. A container knockdown assembly capable of being erected into a container assembly having an inner container for holding goods and an outer cover for enclosing said inner container, said knockdown assembly comprising:

an inner sleeve capable of forming said inner container when said knockdown assembly is erected, said inner sleeve having first and second inner sleeve walls which include inner container sidewalls, a top edge, and a bottom forming flap opposite said top edge;

an outer sleeve capable of forming said outer cover when said knockdown assembly is erected, said outer sleeve having first and second outer sleeve walls which include outer cover sidewalls, a bottom edge, and a top forming flap opposite said bottom edge, said inner sleeve being positioned within said outer sleeve in a positional relationship of the inner container and outer cover of the erected container assembly, said outer sleeve further comprising one or more adhesive overlays formed on a single outer cover sidewall and secured to said inner sleeve wherein at least one of said overlays is formed on each of two opposing ones of said outer cover sidewalls wherein each of said overlays is formed at least in part by a single tear line substantially surrounding said overlays on at least two sides during both a knockdown and erected configuration and allowing said overlays to be detachable from said outer sleeve along said tear line; and adhesive to secure said inner and outer sleeves together in said aligned relationship, said adhesive being applied during the formation of the knockdown configuration and being disposed between said inner container sidewalls and said one or more adhesive overlays so that said overlays can remain attached to said inner container when said overlays are detached from said outer cover and said outer cover is removed from said inner container.

2. A container knockdown assembly in accordance with claim 1 wherein said overlay formed on said opposing sides includes at least a section of said bottom edge, said bottom edge being adjacent to said bottom forming flap of said inner sleeve.

3. A container knockdown assembly in accordance with claim 2 wherein said overlay includes multiple said overlays, each of said overlays being adhered to said inner sleeve.

4. A container knockdown assembly in accordance with claim 3 wherein said multiple overlays include at least two said overlays spaced from one another on at least one of said at least two opposing sidewalls of said outer sleeve.

5. A container knockdown assembly in accordance with claim 2 wherein said overlay comprises a vertical strip extending from said bottom of said outer sleeve towards said top edge of said inner sleeve.

6. A container knockdown assembly in accordance with claim 5 wherein said overlay extends to said top edge of said inner sleeve.

7. A container knockdown assembly in accordance with claim 1 wherein said adhesive comprises a hot melt glue.

8. A container knockdown assembly in accordance with claim 1 wherein said inner and outer sleeves form a substantially flat configuration.

9. A container knockdown assembly in accordance with claim 1 wherein said inner and outer sleeves are aligned relative to one another such that said top edge of said inner sleeve aligns substantially with a fold line between said top forming flap and said sidewalls of said outer sleeve.

10. A container knockdown assembly in accordance with claim 1 wherein said inner and outer sleeves are adapted to be erected into a rectangular shaped container assembly, said top forming flap comprises multiple flaps, said bottom forming flap comprises multiple flaps, and said tear line comprises perforations in said outer cover.

11. A container assembly, comprising:

an inner container having sidewalls for holding goods therein, a top edge, and a bottom forming flap extending from a bottom end of said side walls;

an outer cover having sidewalls for fitting over said sidewalls of said inner container, said outer cover having a bottom edge and a top forming flap extending from a top end of said cover sidewalls, said outer cover further comprising one or more overlays formed on a single outer cover sidewall and secured to said inner sleeve wherein at least one of said overlays is formed on each of two opposing ones of said outer cover sidewalls wherein each of said overlays is formed at least in part by a single tear line substantially surrounding each of said overlays on at least two sides during both a knockdown and an erected configuration and allowing said overlay to be detached from said outer cover along said tear line, said inner container being positioned within said outer cover; and adhesive to secure said inner container and said outer cover together, said adhesive being applied during the formation of the knockdown configuration and being disposed between said inner container side walls and said overlays of said outer cover so that said overlays can remain attached to said inner container if said overlays are detached from said outer cover and said outer cover is removed from said inner container.

12. A container assembly in accordance with claim 11 wherein said overlay formed on said opposing sides includes at least a section of said bottom edge, said bottom edge being adjacent to said bottom forming flap of said inner sleeve.

13. A container assembly in accordance with claim 12 wherein said overlay includes multiple said overlays, each of said overlays being adhered to said inner container.

14. A container assembly in accordance with claim 13 wherein said multiple overlays include at least two said overlays spaced from one another on at least one of said at least two opposing sidewalls of said outer cover.

15. A container assembly in accordance with claim 12 wherein said overlay comprises a vertical strip extending from said bottom of said outer cover towards said top edge of said inner container.

16. A container assembly in accordance with claim 15 wherein said overlay extends substantially to said top edge of said inner container.

17. A container assembly in accordance with claim 11 wherein said container assembly is capable of being erected from a knockdown state having an outer sleeve and an inner sleeve disposed within said outer sleeve, said outer sleeve having two walls which include said outer cover sidewalls, said inner sleeve having two walls which include said inner container sidewalls, and wherein said inner container and said outer sleeve are adhesively attached to one another by said adhesive.

18. A container knockdown assembly capable of being erected into a container assembly having an inner container for holding goods and an outer cover for enclosing said inner container, said knockdown assembly comprising:

an inner sleeve capable of forming said inner container when said knockdown assembly is erected, said inner sleeve having first and second inner sleeve walls which include inner container sidewalls, a top edge, and a bottom forming flap opposite said top edge;

an outer sleeve capable of forming said outer cover when said knockdown assembly is erected, said outer sleeve having first and second outer sleeve walls which include outer cover sidewalls, a bottom edge, and a top forming flap opposite said bottom edge, said inner sleeve being positioned within said outer sleeve, said outer sleeve further comprising one or more adhesive overlays formed a single outer cover sidewall wherein at least one overlay is formed on each of two opposing ones of said outer cover sidewalls wherein each overlay is formed at least in part by a single tear line surrounding the overlay on at least two sides during both a knockdown and erected configuration and allowing said overlay to be detachable from said outer sleeve; and adhesive to secure said inner and outer sleeves together in said aligned relationship, said adhesive being applied during the formation of the knockdown container and being disposed between said inner container sidewalls and said overlay so that said overlay can remain attached to said inner container when said overlay is detached from said outer cover and said outer cover is removed from said inner container.

19. A container knockdown assembly in accordance with claim 18 wherein adhesive to secure said inner and outer sleeves together is disposed only between said inner container sidewalls and said overlay.

20. A container knockdown assembly in accordance with claim 1 wherein adhesive to secure said inner and outer sleeves together is disposed only between said inner container sidewalls and said overlay.

21. A container assembly in accordance with claim 11 wherein adhesive to secure said inner container and said outer sleeve together is disposed only between said inner container sidewalls and said overlay.

* * * * *